US008303729B2

(12) United States Patent
Levers

(10) Patent No.: US 8,303,729 B2
(45) Date of Patent: Nov. 6, 2012

(54) AIRCRAFT COMPONENT MANUFACTURING TOOL AND METHOD

(75) Inventor: Andrew Levers, Chester (GB)

(73) Assignee: Airbus Operations Limited, Bristol (GB)

( * ) Notice: Subject to any disclaimer, the term of this patent is extended or adjusted under 35 U.S.C. 154(b) by 2121 days.

(21) Appl. No.: 10/539,016

(22) PCT Filed: Dec. 15, 2003

(86) PCT No.: PCT/GB03/05462

§ 371 (c)(1),
(2), (4) Date: Jun. 16, 2005

(87) PCT Pub. No.: WO2004/054735

PCT Pub. Date: Jul. 1, 2004

(65) Prior Publication Data

US 2007/0120013 A1 May 31, 2007

(30) Foreign Application Priority Data

Dec. 18, 2002 (GB) ..... 0229435.3

(51) Int. Cl.
*C22C 1/00* (2006.01)

(52) U.S. Cl. ..... 148/95; 72/60; 72/413

(58) Field of Classification Search ..... 148/95; 72/60, 413

See application file for complete search history.

(56) References Cited

U.S. PATENT DOCUMENTS

| | | | | |
|---|---|---|---|---|
| 6,053,026 | A | 4/2000 | Nardiello et al. | |
| 6,089,061 | A * | 7/2000 | Haas et al. | 72/14.8 |
| 6,264,771 | B1 | 7/2001 | Bornschlegl et al. | |

FOREIGN PATENT DOCUMENTS

| | | |
|---|---|---|
| EP | 0 261 646 | 3/1988 |
| EP | 0 507 033 | 10/1992 |
| EP | 0 570 212 | 11/1993 |
| FR | 2 607 099 | 5/1988 |
| GB | 2 284 569 | 6/1995 |

OTHER PUBLICATIONS

International Search Report for PCT/GB03/05462 dated Apr. 8, 2004.
European Search Report for EP 02 25 8719 dated Jul. 1, 2003.
Great Britain Search Report for 0229435.3 dated Mar. 21, 2003.

* cited by examiner

*Primary Examiner* — Jessica L Ward
*Assistant Examiner* — Nicholas D'Aniello
(74) *Attorney, Agent, or Firm* — Nixon & Vanderhye P.C.

(57) ABSTRACT

A creep forming tool modifies the shape of an aircraft component in the form of a wing skin portion. The tool includes a shaped surface defined by removable rib boards. The component is forced against the shaped surface, via a reusable intermediate plate. The shape of the shaped surface may be adjusted, if necessary, by replacing the rib boards with boards of a different shape.

36 Claims, 5 Drawing Sheets

AIRCRAFT COMPONENT MANUFACTURING TOOL AND METHOD

Figure 1A:
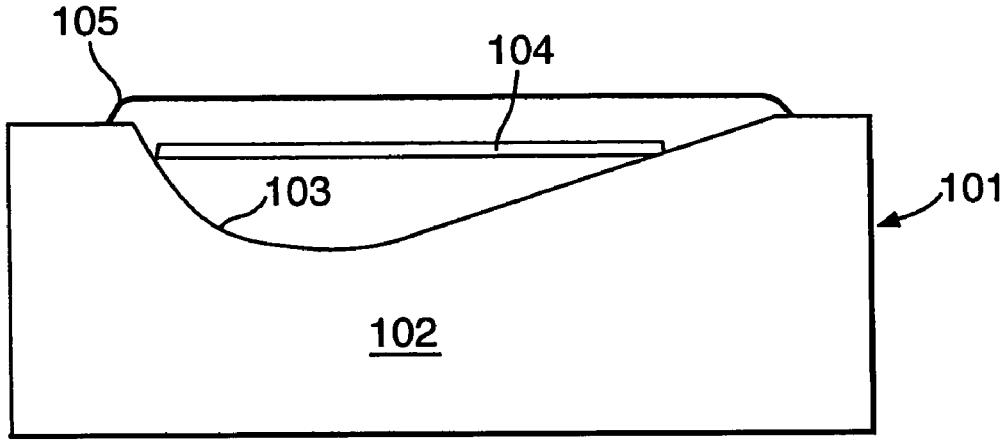

This application is the US national phase of international application PCT/GB2003/005462 filed 15 Dec. 2003 which designated the U.S. and claims benefit of GB 0229435.3, filed 18 Dec. 2002, the entire contents of each of which are hereby incorporated by reference.

The present invention relates to modifying the shape of an aircraft component, and in particular, but not exclusively to creep forming a metallic aircraft component so that it adopts a complex shape.

Portions of the metal wing skin of an aircraft may be manufactured with a creep forming process, wherein a portion of flat sheet material is caused to adopt the complex target shape of a given portion of the wing skin. In such a process the wing skin component in generally flat form is, for a given length of time (generally several hours), forced against a forming surface of a creep forming tool. As a result the component undergoes creep and hardens by means of precipitation hardening. When released from the creep forming tool, the component skin springs back to a shape dependent on the complex shape of the forming surface. The forming surface is so shaped that after spring back, the component adopts a shape substantially the same as that of the target shape. It is extremely difficult to predict the shape of the forming surface of the moulding tool that is required in order to obtain a given target shape of component. Once the appropriate shape has been discovered, however, components may thereafter be reliably manufactured to the target shape, within a given tolerance. Also, whilst it may prove difficult to discover the best shape for the shaped surface of the forming tool, forming components in this way enables the production of components having both good physical properties and the desired shape. Furthermore, creep forming components in this way, because it hardens and shapes the component in one process, is a relatively efficient method of aircraft component manufacture. Thus, despite the disadvantages associated with initially setting up the process for a given component and in particular identifying an ideal (or acceptable) shape of the shaped forming surface of the tool, creep forming components has its substantial advantages.

The present invention seeks to provide an improved apparatus and/or method for modifying the shape of an aircraft component.

According to a first aspect of the invention there is provided an apparatus for modifying the shape of an aircraft component, the apparatus including a shaped surface so arranged that an aircraft component may be forced against the shaped surface in a manner that modifies the shape of the aircraft component, wherein the shaped surface is arranged so that its shape is adjustable.

The shaped surface being arranged so that its shape is adjustable, enables the apparatus to be built without needing to be very confident that the shaped surface has a shape such that it will be able to be used to produce components of the target shape, because the shape of the shaped surface may be readily adjusted if it transpires that the shaped surface is not able to produce a component of the correct, or target, shape (or to a shape that differs only within acceptable tolerances).

Figure 1B:
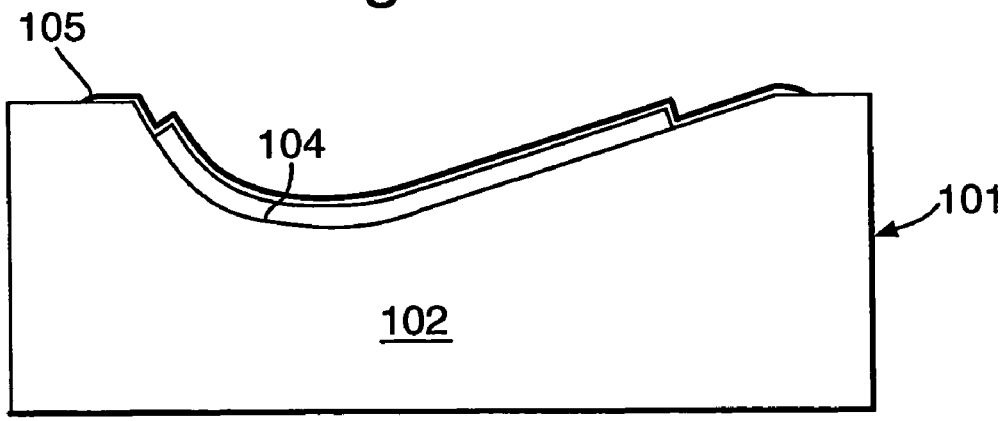

The adjustable apparatus of the present invention is particularly advantageous compared to a prior art creep forming tool with a forming surface having a fixed shape. An example of such a prior art creep forming tool is illustrated by FIGS. 1*a* and 1*b*, which show schematically a typical construction of a creep forming tool 101, both before operation (FIG. 1*a*) and during creep forming of a component 104 (FIG. 1*b*). The tool

101 includes a substantially solid base 102 on top of which there is permanently fixed (by welding) a forming surface 103 in the form of a shaped sheet of steel that is supported across substantially its entire surface by the base 102. The shape of the forming surface 103 is calculated before manufacture of the tool 101. However, the mathematical models available in the prior art are not reliable and it is often the case that the shape the forming surface 103 of the tool 101 is at least in certain regions incorrect. In such a case, the tool 101 may thereafter require substantial modification in order to correct the shape of the forming surface 103. Moreover, in many cases, the need to change the shape of the forming surface 103 in one region will require a change in the position or shape of a different region of the surface 103 and substantial modification of the structure of the tool 101. Attaining the correct shape of the forming surface 103 of the tool 101 may require more than one round of modifications to the tool 101 and to the shape of the forming surface 103. Thus, if the fixed forming surface 103 of such a creep forming tool 101 is incorrectly shaped it can be extremely time consuming and labour intensive to alter the shape. However, once the correct shape of the forming surface 103 is attained the shape need never be changed again, unless of course the starting or end conditions change (for example if the composition of the component 104 changes, or if the target shape of the component 104 changes).

The present invention also provides according to a second aspect of the invention, an apparatus for modifying the shape of an aircraft component, the apparatus including a shaped surface so arranged that an aircraft component may be forced against the shaped surface in a manner that modifies the shape of the aircraft component, wherein the apparatus further includes an intermediate member that in use receives and supports the component, is positioned between the shaped surface and the component, and deforms to a shape dependent on the shape of the shaped surface. Providing such an intermediate member, enables the apparatus to be more easily modified.

As mentioned above, the tool of the prior art shown in FIGS. 1*a* and 1*b* is inflexible and also costly and difficult to modify. The forming surface 103 of the tool 101 of the illustrated prior art must both support the component 104 whilst it is forced to conform to a particular shape and must also define the shape to which the component 104 is forced to conform. According to this second aspect of the invention, and by way of contrast, the function of supporting the component whilst it is forced to conform to a particular shape is advantageously performed by the intermediate member, whereas the function of defining the shape to which the component is forced to conform is advantageously provided not by the intermediate member, but by the shaped surface of the apparatus. The shaped surface of the apparatus need not therefore be completely solid across the surface closest to the component, in contrast to the construction of the tool 101 of the prior art illustrated in FIGS. 1*a* and 1*b*. Being able to have a shaped surface having a non-solid structure may allow the shaped surface to have certain advantageous features as is explained in further detail below. Moreover, the provision of a flexible intermediate member removes the need to machine the complex shape of a solid supporting and forming surface as required in the prior art.

The apparatus of the first aspect of the invention may also further include an intermediate member that in use receives and supports the component, is positioned between the shaped surface and the component, and deforms to a shape dependent on the shape of the shaped surface.

The intermediate member is preferably simple to construct. The intermediate member may be generally sheet-like in shape. The intermediate member may have a constant thickness across the majority of its area. The intermediate member may, prior to use of the apparatus, be substantially flat. The intermediate member may be made from a plurality of separate parts. The parts may be of the same size (within a factor of 2). The parts may be joined together. However, it is preferred that the parts are not joined (and preferably not specially configured for joining), but are instead placable in position relative to each other in use. During use the relative positions of the parts may be substantially maintained by means other than directly joining the parts.

The intermediate member is preferably reusable. The intermediate member is preferably able to deform repeatedly to substantially the same shape, that shape being dependent on the shape of the shaped surface.

The shaped surface is advantageously defined by an open structure. The open structure may for example be open in that the notional surface that smoothly envelopes the structure in the region of the shaped surface bridges openings, holes, gaps or the like in the shaped surface. The open structure may include elements separated by gaps. In such a case, the shape to which the component may be modified is dependent on the shape defined by the notional smooth surface enveloping the elements and bridging the gaps. The intermediate member is advantageously sufficiently stiff that in use during the forcing of the aircraft component against the shaped surface, the intermediate member deforms substantially to the shape of said notional smooth surface, but suffers substantially no local deformation in regions of the intermediate member that bridge the gaps.

The intermediate layer is advantageously arranged to be free to move over the shaped surface within predefined boundaries. Allowing the intermediate member to be so freely movable means that there is no need for locating elements for fixing the intermediate member in fixed position and therefore simplifies construction and operation of the apparatus.

The apparatus may be arranged such that the aircraft component is free to move in directions substantially parallel to the shaped surface. The apparatus is preferably arranged such that, in use, the aircraft component is prevented from moving beyond predefined boundaries.

Allowing the aircraft component to be so freely movable means that there is no need for locating elements for fixing the aircraft component in fixed position and therefore simplifies construction and operation of the apparatus. Also, fixing the position of more than one point of the component can create internal stresses within the component when the component is forced to conform to the shape of the shaped surface. The component may of course be fixed at a single point relative to the apparatus. The freedom of movement of the intermediate member and/or the component may be limited in distance, the distance being relatively short compared to the maximum dimension of the component. For example, the distance may be less than 1 cm and is preferably of the order of a few millimeters. Such a distance is very small in comparison to the possible size of a component which might, for example, have a length of greater than 10 m or even 30 m.

The predefined boundaries mentioned above may be defined by at least one stop. The at least one stop may be in the form of a raised element. There may be a plurality of stops. In the case where the apparatus includes a base, the or each stop may be fixed to the base and extend from the base past the shaped surface.

The apparatus advantageously includes a base which provides structural support for the shaped surface. The apparatus preferably includes a base comprising a plurality of base modules. The base modules are preferably fixed in position relative to each other during operation of the apparatus to modify the shape of the aircraft component. The position of a base module relative to another base module is advantageously adjustable. The base modules may be so arranged that the position is adjustable with only one degree of freedom. The apparatus is advantageously so arranged so that an adjacent pair of base modules are pivotally movable relative to each other. Arranging the base modules to be adjustable to one another allows the global shape of the shaped surface to be altered without needing to alter the structure of the shaped surface, or at least without needing to alter significantly the structure of the shaped surface. Whilst, it is preferred that the shape of the shaped surface be fixed during operation of the apparatus to modify the shape of the aircraft component, the apparatus could be arranged such that the shape of the shaped surface changes during said operation. For example, the base modules could be moved during operation of the apparatus to modify the shape of the aircraft component.

There may be as few as two or three base modules and there may be as many as ten or more modules. There are preferably a multiplicity of base modules. In the embodiment described below there are four base modules. The apparatus is advantageously so arranged that the base modules are arranged in a single row.

As mentioned above, the shaped surface advantageously comprises an open structure. For example, the open structure may comprise a multiplicity of spaced apart elements. The shape to which the component may be modified may be dependent on the shape defined by a notional surface that envelopes the elements. Thus, the apparatus may advantageously be so configured that if the shape of the shaped surface needs adjusting it may be necessary only to adjust or alter the shapes of a small number of elements in comparison to the total number of the elements. The shaped surface is advantageously defined by a multiplicity of separate elements. The elements are preferably arranged in groups, each group comprising a plurality of elements. The elements in each group are preferably mounted in fixed relation to each other. The elements are preferably spaced apart from each other. The elements may each be in a form having a characteristic of shape that is substantially the same for each element (for example to ease manufacture of the elements). For example, each element may have the same thickness, the same cross-sectional shape, or share some other characteristic of shape. The elements are preferably in the form of ribs. Each rib may for example have the same general thickness. The ribs may be similar in function, and therefore construction, to the ribs in an aircraft wing.

The spacing between successive elements may conveniently be the same. However, the apparatus may be arranged such that the spacing between successive elements is different at different regions of the apparatus. It may be necessary for there to be more elements per unit length in certain regions. For example, if the part of each element that defines the shape of the shaped surface has the substantially the same unit area (or the same width in the direction of successive elements, for example in the case where the elements are in the form of ribs), then there may be regions of the shaped surface that have a shape that varies greatly requiring more elements per unit area/length than in regions where the shape does not vary so greatly.

The elements are advantageously removably mounted on the apparatus. Thus, the shape of the shaped surface may be readily adjusted by removing and replacing one or more elements with one or more elements of a different shape.

The elements may be fixed in position on the apparatus by means of a portion of the element that engages with a corresponding portion of the apparatus. The portions and corresponding portions are preferably shaped such that they do not restrict movement of the elements away from the apparatus. For example, the elements may able to be slotted into the apparatus, by suitably aligning the portion of the element with the corresponding portion of the apparatus and then causing one to be inserted into the other.

Preferably, the shape of the shaped surface does not significantly alter from one operation of the apparatus to the next. The shaped surface is preferably rigid. The shaped surface is preferably so configured has that during use of the apparatus the shaped surface undergoes substantially no deformation.

The shaped surface preferably has a surface area greater than 1m2, and more preferably greater than 5m2. The invention has particular application when the shaped surface has an area greater than 10m2. In the embodiment described below, the surface area is greater than 25m2.

The shaped surface is preferably so arranged and configured for modifying the shape of components, wherein the surface of the component that is forced against the shaped surface is generally smooth in shape both before and after having its shaped modified.

The component may, during use of the apparatus, be forced against the shaped surface by any suitable means. A mechanical clamping force could for example be utilised. Preferably, however, the apparatus is arranged such that the component is, in use, forced against the shaped surface by means of an air pressure difference. Preferably, the air pressure difference is at least partially provided by suction. The apparatus may for example include a bagging apparatus, via which the suction may be provided. Various important features of the present invention relate to the provision of, and arrangement of, such a bagging apparatus.

According to a third aspect of the invention there is provided an apparatus for modifying the shape of an aircraft component, the apparatus including a shaped surface so arranged that an aircraft component may be forced against the shaped surface in a manner that modifies the shape of the aircraft component, wherein the apparatus is arranged such that the component is, in use, forced against the shaped surface by means of an air pressure difference that is at least partially provided by suction via a bagging apparatus.

The bagging apparatus, for example, comprises a bag and a source of suction. The apparatus is preferably arranged such that the bagging apparatus, in use, must encompass both the aircraft component and at least a portion of the apparatus on the opposite side of the shaped surface to the aircraft component.

The apparatus may include a base which supports the shaped surface. In such a case the apparatus is advantageously arranged such that the bagging apparatus, in use, must at least partially be sealingly attached to the base. The bagging apparatus, in use, may be sealingly attached to the base by means of an endless seal. The bagging apparatus may, in use, encompass substantially the whole of the part of the apparatus that defines the shape of the shaped surface, that part being positioned between the shaped surface and the base. Having a bagging apparatus arranged in any of the manners described immediately above enables the structure between the base of the apparatus and the shaped surface of the apparatus to be an open structure and/or a structure in which there are gaps, which in turn enables that part of the apparatus to be constructed to provide advantageous features that might not otherwise be feasible. For example, consider the prior art apparatus illustrated by FIGS. 1*a* and 1*b*. A bag 105 is attached to the tool 101 very near to or on the upper shaped surface 103 of the tool 101. In order for air to be drawn from the region between the bag 105 and the shaped surface 103, the shaped surface 103 must be completely airtight. In practice, the shaped surface 103 is generally formed from a solid sheet of tooling metal that is fixed to the base 102.

At least the bag of the bagging apparatus of the present invention is preferably reusable. Having a reusable bagging apparatus may be especially advantageous when the volume that the bag must encompass is of significantly greater volume than the aircraft component. The suction is preferably provided by a vacuum pump.

The invention is of particular advantage when the apparatus is in the form of a creep-forming tool and/or when the apparatus is arranged so that it is suitable for modifying the shape of metallic components. The invention may of course have application as an apparatus that modifies the shape of a component in a different manner or as an apparatus for forming non-metallic components. For example, the apparatus could be of application in relation to forming components from composite materials, for example, where the component is formed from a multiplicity of fibre layers in a resin matrix.

The invention also provides according to a fourth aspect a method of modifying the shape of an aircraft component, the method including the steps of providing a shaped surface, the shape of which being adjustable, forcing an aircraft component against the shaped surface in a manner that modifies the shape of the aircraft component, and removing the aircraft component.

The method may further include the steps of observing the modified shape of the aircraft component and comparing the modified shape so observed with an ideal shape. If the modified shape of the aircraft component is identical to the ideal shape, or sufficiently close to the ideal shape for practical purposes, then the shaped surface need not be adjusted. If the modified shape of the aircraft component is not sufficiently close to the ideal shape, then the shaped surface may need to be adjusted. The method may further include the step of adjusting the shape of the shaped surface to compensate for the differences between the observed modified shape of the aircraft component and the ideal shape.

The method may include a step of forcing a further aircraft component against the adjusted shaped surface in a manner that modifies the shape of the aircraft component, and then removing the further aircraft component. The method may also include a step of then observing the modified shape of the further aircraft component and comparing the modified shape so observed with the ideal shape. Of course, the observed shape may still not be close enough to the target shape and the shaped surface may need to be adjusted more than once in order to enable the shaped surface to produce components of the target shape.

The following steps are preferably performed as many times as are necessary until the differences between the observed modified shape of the aircraft component and the ideal shape are within predetermined acceptable tolerances:

adjusting the shape of the shaped surface to compensate for the differences between the observed modified shape of the aircraft component and the ideal shape and then forcing a further aircraft component against the adjusted shaped surface in a manner that modifies the shape of the aircraft component, removing the further aircraft component, observing the modified shape of the further aircraft component and comparing the modified shape so observed with the ideal shape.

The invention yet further provides according to a fifth aspect a method of modifying the shape of an aircraft component, the method including the steps of providing a shaped surface and an intermediate member, forcing an aircraft component against the shaped surface, via the intermediate member, in a manner that modifies the shape of the aircraft component, and removing the aircraft component.

The step of the fourth aspect of the invention of forcing the aircraft component against the shaped surface may be performed such that the aircraft component is forced against the shaped surface, via an intermediate member.

The intermediate member advantageously receives and supports the component. Advantageously, the intermediate member is positioned between the shaped surface and the component. The intermediate member advantageously deforms to a shape dependent on the shape of the shaped surface. The intermediate member may be sufficiently stiff that, in use during the forcing of the aircraft component against the shaped surface, the intermediate member deforms substantially to the shape of said notional smooth surface, but suffers substantially no local deformation in regions of the intermediate member that bridge the gaps.

The intermediate member may have any of the features described above with reference to the apparatus of the present invention. The intermediate layer may be arranged to be free to move over the shaped surface within predefined boundaries Immediately prior to the performance of the step of forcing the component against the shaped surface, the intermediate member is preferably substantially flat.

The method according to any aspect of the invention is advantageously performed a multiplicity of times. When an intermediate member is used, it is preferred that the same intermediate member is used on each occasion.

The method is preferably so performed that during the step of forcing of the aircraft component against the shaped surface, the aircraft component undergoes plastic deformation. For example, the component may undergo some form of heat treatment. The component may for example be placed in an oven, autoclave or similar apparatus. Preferably, the heat treatment is applied after the aircraft component is initially forced against the shaped surface. In such a case the initial (cold) deformation of the component may be largely elastic with little or substantially no plastic deformation. The component may undergo some elastic deformation. The method will normally include a step of releasing the component from the shaped surface. After the release of the component, the shape of the component may change significantly. When the method is performed on a metal component in such a way that causes the metal to creep (i.e. a creep forming method), the changing of the shape of the component may be described as spring-back.

The method may be used to make components of any desired shape. The components may for example be components that may be made from substantially flat sheets of material, such as a portion of a wing skin.

Before performance of the step of forcing of the aircraft component against the shaped surface, the aircraft component may be generally flat in shape. It will be appreciated that in the case where the component is a wing skin, one side of the wing skin may be flat, whereas the other side is not completely flat, such that the component has regions of significantly different thickness. It is preferred that if the component has a flat face and a non-flat face, that the flat face is placed against the shaped surface.

During performance of the step of forcing the aircraft component against the shaped surface, the aircraft component may slide over the shaped surface within predefined boundaries. The relation sliding, or slipping, of the surfaces may be due primarily to stretching of the component in given regions by virtue of the stresses within the component caused by it being forced to conform to the shape of the shaped surface. For example, and as is preferred, there is no single point at which the aircraft component is fixed in relation to the shaped surface. Therefore all points on the aircraft component may slide against and relative to the shaped surface. Fixing the aircraft component relative to the shaped surface could cause undesirable internal stressing of the component during the step of forcing of the aircraft component against the shaped surface.

As mentioned above, the shaped surface is advantageously supported (directly or indirectly) by a plurality of base modules. Before the step of forcing of the aircraft component against the shaped surface, the method may include a step of adjusting and fixing the position of one base module relative to another.

Advantageously, the fixing of the positions of the base modules is readily changeable. For example, the changing of the positions advantageously does not include any step that is destructive in nature. In the embodiment described below the fixing of the relative positions of the base modules does not include any welding steps. Preferably, the step of adjusting and fixing the position of one base module relative to another is performed between successive steps of forcing of the aircraft component against the shaped surface.

As mentioned above, the shaped surface may be defined by a multiplicity of separate elements. Before the step of forcing of the aircraft component against the shaped surface, the method may include a step of adjusting the shape of the shaped surface by replacing one or more of the separate elements. For example, a component previously produced by the shaped surface may be incorrectly shaped or the shaped surface may need altering in order to produce components of a slightly different shape (because for example the design of the component has been altered, thereby altering the target shape).

Preferably, the step of replacing one or more of the separate elements is performed between successive steps of forcing of the aircraft component against the shaped surface.

The step of adjusting the shape of the shaped surface preferably includes replacing a group of a plurality of separate elements. The replacing of an element preferably includes the steps of simply lifting the element from a surface on which it is supported and removing the element, and providing and moving a replacement element until it locates itself into position (for example by slotting into position). The elements may be arranged in the manner described with reference to any of the aspects of the apparatus of the present invention as described herein.

During the step of forcing the aircraft component against the shaped surface, the shaped surface preferably undergoes substantially no plastic strain. Preferably, there is no significant elastic strain of the shaped surface.

The aircraft component is advantageously forced against the shaped surface by means of an air pressure difference. The air pressure difference may at least partially be provided by suction and is preferably provided via a bagging apparatus including a bag. The air pressure difference is conveniently at least about 1 bar. The air pressure difference may be greater than 1 bar, but of course such pressure differences would not be achievable solely by means of suction. The pressure may be increased by means of using an autoclave or other vessel able to create an environment having a pressure substantially greater than atmospheric pressure.

There is also provided according to a sixth aspect of the invention a method of modifying the shape of an aircraft component, the method including the steps of providing a shaped surface, forcing, by means of an air pressure difference, an aircraft component against the shaped surface in a manner that modifies the shape of the aircraft component, and removing the aircraft component, wherein the air pressure difference is at least partially provided by suction via a bag of a bagging apparatus.

The shaped surface may be supported by a support structure. In such a case, the bag preferably encompasses both the aircraft component and at least a portion of the support structure on the opposite side of the shaped surface to the aircraft component.

Preferably, the bag encompasses both the aircraft component and at least a portion of the support structure that supports the shaped surface. In the embodiment described below, the support surface encompassed by the bag is on the opposite side of the shaped surface to the aircraft component. Such a method enables the support structure to be an open structure. A part of the support structure may form (or define) the shaped surface.

The shape of a further aircraft component may be modified by performing the method with the use of the same bagging apparatus. In particular, the same bag is preferably used. Whilst the same bagging apparatus may be re-used it will be understood that certain sealing materials, such as bag tape, if required may not be reusable.

The method may of course be used to modify the shape of a metallic aircraft component. The method may be incorporated in a method of creep forming an aircraft component.

The present invention is of particular application to a method of creep forming a metallic component. Such a creep forming method may include for example the use of an apparatus according to any of the first to third aspects of the present invention or the performance of the steps of the method according to any of the fourth to sixth aspects of the present invention.

It will be appreciated that the apparatus and method of the invention may be used to modify the shape of aircraft components, which, before the use of the apparatus or performance of the method, have already been subjected to various manufacturing processes. Further manufacturing processes may of course be performed after the shape of a component has been modified. It will therefore be understood that the term component is used herein both to refer to the component in a state ready for final assembly and to earlier stages in the component's manufacture.

The present invention also provides an aircraft component formed by the use of an apparatus according to any of the first to third aspects of the present invention or the performance of the steps of the method according to any of the fourth to sixth aspects of the present invention. The aircraft component so formed may for example be a wing skin or a portion thereof. The invention is of course of particular advantage when the aircraft component so formed has a shape that is relatively complicated. For example, the shape of the component, once modified, may be irregular and not easily definable mathematically. More than 50 parameters may for example be required to define adequately the shape of the shaped surface or the modification to be made to the shape of the component. More than 200 parameters may for example be required.

The aircraft component so formed may for example be part of a complex structure such as a wing, a fuselage or any other part of an aircraft. The embodiments of the present invention described below relate to the forming of a section of the wing skin of an aircraft. It will of course be appreciated that the present invention may be applicable to other component parts of an aircraft. Such components include, in particular, any part that is required to have a complex shape and that may be caused to adopt that complex shape (within acceptable tolerable differences) from an initial different shape by means of forcing the component against an appropriately shaped surface. The invention also has particular application in relation to metallic components that need to be hardened by precipitation hardening. It will be apparent to the skilled person that the invention has particular application to components able to be formed from sheet material such as skin sections, but it should also be appreciated that the invention has application in relation to components, which are generally not flat in shape, even immediately before modifying their shape.

The present invention yet further provides an aircraft including an aircraft component as described above.

It will of course be appreciated that any preferred or optional features of one aspect of the present invention may be incorporated into any other aspect of the invention. For example, any aspect of the method of the invention may be performed with an apparatus of the invention incorporating features of a given aspect of the apparatus of the invention. The apparatus may furthermore be so configured that it is able to perform the method of the invention.

Figure 2A:
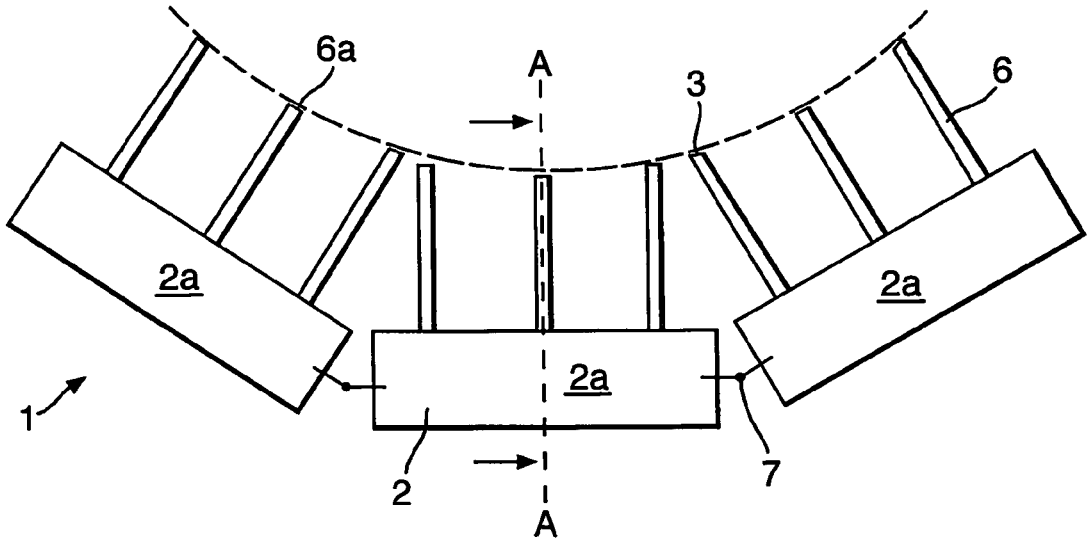
Figure 2B:
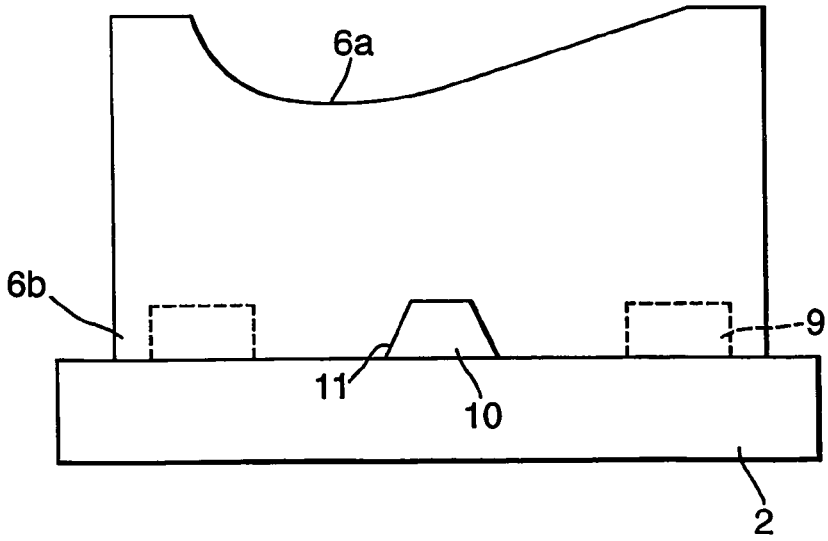
Figure 3A:
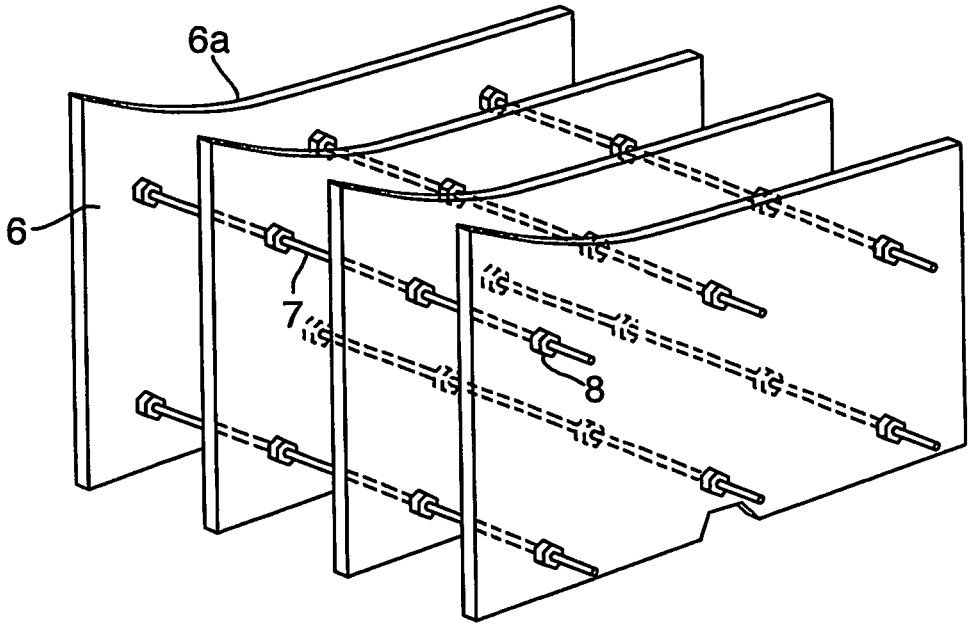
Figure 3B:
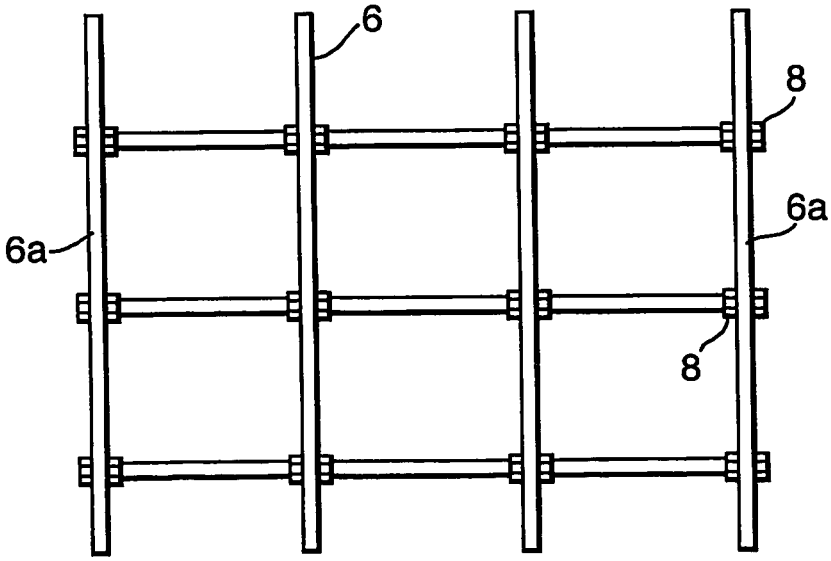
Figure 4:
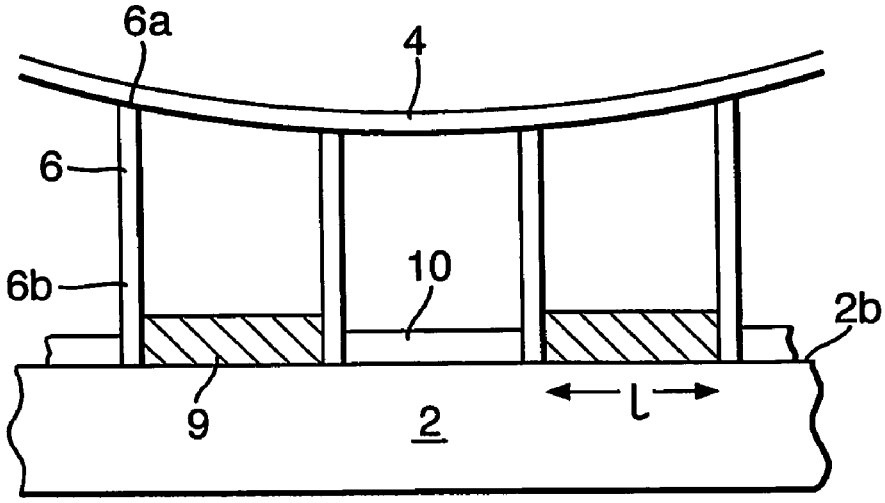
Figure 5:
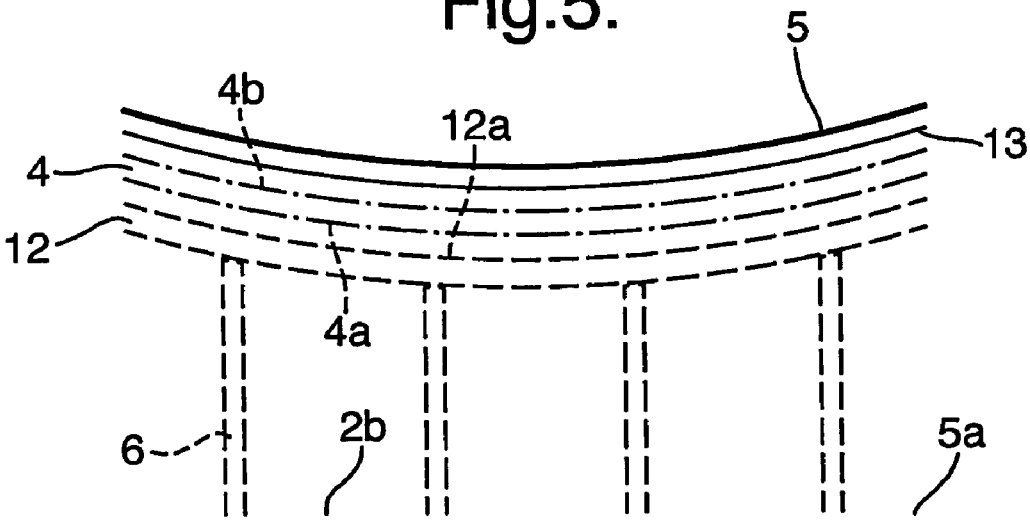
Figure 6:
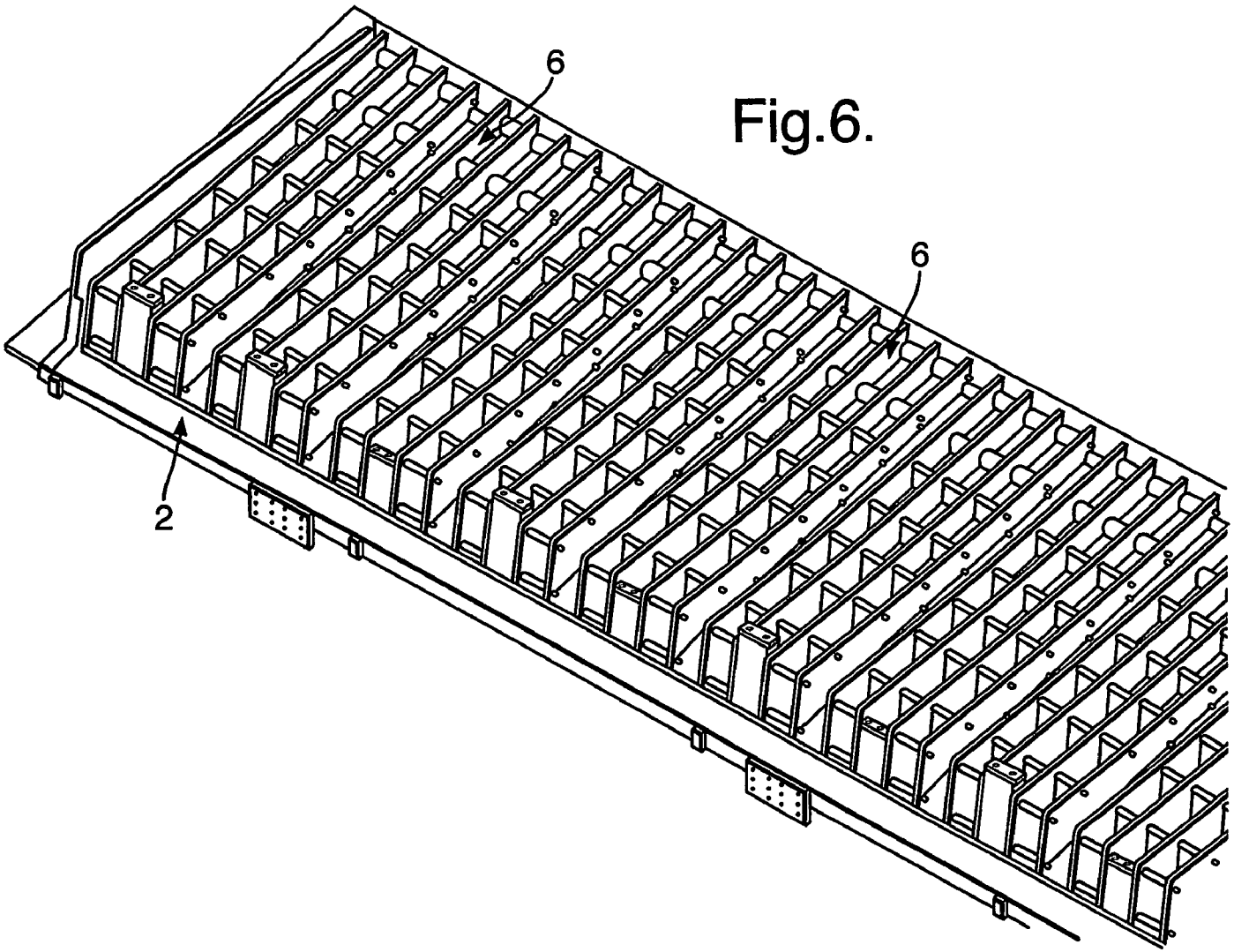

By way of example, embodiments of the present invention will now be described with reference to the following highly schematic drawings of which:

FIG. 1*a* and 1*b* show a creep forming tool of the prior art,

FIG. 2*a* shows a creep forming tool according to an embodiment of the present invention, FIG. 2*b* shows a section of the tool of FIG. 2*a* along the line A-A, FIG. 3*a* is a perspective view of a part of the tool including a group of rib boards, FIG. 3*b* is a plan view of the group of rib boards of FIG. 3*a*, FIG. 4 is a side view showing how the rib boards locate on the base of the tool, FIG. 5 shows the tool of the embodiment together with a bag placed over the tool, and FIG. 6 shows a perspective view from above of a section of the tool showing the configuration and arrangement of the rib boards.

FIGS. 2*a* and 2*b* show a creep forming tool 1 for producing an aircraft component 4 (not shown), in the form of a metal wing skin portion of a complex shape. The component initially has a shape that is generally flat. The bottom face of the component 4 is substantially planar, whereas the top face, whilst generally flat, has a complicated structure, which enables the wing skin both to provide a smooth aerofoil surface (the lower face) and to have certain mechanical properties (provided by the varying thickness of the skin, which is defined by the structure of the upper face).

The tool 1 comprises a base 2 on which there are supported a plurality of rib boards 6. The base 2 includes a movable support structure (not shown in FIGS. 2*a* and 2*b*) in the form of a bogie unit (or support trolley). The uppermost surfaces 6*a* of the rib boards 6 define a shaped surface, against which the component 4 is forced, via an intermediate plate 12 (also not shown in FIGS. 2*a*, 2*b*), for a predetermined length of time in a manner that is described in further detail below. The lower flat surface of the component 4 is thus forced to adopt a shape substantially the same shape as the notional surface (represented by the dotted line 3 in FIG. 2*a*) that smoothly envelopes the upper surfaces 6*a* of the rib boards 6. After the component 4 is released, it springs back into a shape determined by the shape of the shaped surface defined by the rib boards 6.

The apparatus illustrated is used to produce wing skin portions. In this case, each wing skin portion is about 33m in length and has a maximum width of 2.7m. The thickness of the wing skin varies from about 2mm up to about 32mm. The apparatus is therefore elongate in nature and has a long length and a short width. The intermediate plate 12 is in the form of a stainless steel 8mm thick plate, which when the component 4 is forced against the rib boards 6, supports the component and is positioned between the component 4 and the rib boards 6. The intermediate plate is, when not subjected to any load, substantially flat and is very slightly larger in plan view than the component 4 which it supports.

The base 2 comprises four base modules 2*a* (only three of which are shown in FIG. 2*a* for the sake of clarity). The base modules 2 are arranged in series and adjacent modules 2 are pivotally connected. The position of one module 2 relative to the adjacent module is temporarily fixed by means of an angle piece 7 (illustrated schematically in FIG. 2*a*). (The angle between adjacent base modules has been exaggerated in FIG. 2*a* to illustrate the principle of operation clearly.) The angle piece 7, in the form of a wide angle plate, is bolted via a sealing gasket to the two base modules. Each base module 2*a* includes its own independently movable support structure (i.e. the bogie mentioned above) on which the main body of the base is supported. Many rib boards 6 are provided in series on each base module (only three being shown in FIG. 2*a* for the sake of clarity).

As shown more clearly in FIGS. 3*a* and 3*b*, the rib boards 6 are grouped in banks of four rib boards 6, the rib boards 6 in each bank being fixed and spaced apart by means of spacing rods 7 that run between the rib boards and are fixed in place by bolts 8. Each rib board has six positions at which spacing rods are attached to it, there being one at each corner, one in the middle towards the top of the rib board 6 and one in the middle towards the bottom of the rib board 6. In FIG. 3*a* only one set of spacing rods 7 and bolts 8 is illustrated for the sake of clarity, although the positions of the other rods are indicated by crosses X. FIG. 6 shows in perspective a view from above of a section of the tool showing the configuration and arrangement of the rib boards 6.

With reference to FIGS. 2*b* and 4, the rib boards 6 are removably located on the uppermost surface 2*b* of the base 2, by means of a combination of at least four (only two being shown in FIGS. 2*b* and 4 for the sake of clarity) lengthwise lines of spacing blocks 9 on the base 2 and at least one rod 10 that extends along the central length of the base 2. Two lines of spacing blocks are provided on one side of the rod, and two on the other, the lines of blocks and the rod all being roughly evenly spaced apart across the width of the base. In regions where the width of the support surface is greater, such that each rib board is longer, then more than one rod 10 and/or more than four spacing blocks 9 are provided to provide adequate coverage across the width of the base. Where the width of the base 2 is at its widest, eight lines of spacing blocks 9 are provided across the width of the base 2.

The spacing blocks 9 are so positioned that the lower portion 6*b* of each rib board 6 is positioned against the side of a block 9. The spacing of the blocks 9 is such that two rib boards 6 are positioned between a pair of adjacent blocks 9. Thus each rib board 6 contacts a single block 9. The ribs are equally spaced apart and as such the distance between spacing blocks 9 is equal to the length l of a spacing block plus the thickness of two rib boards 6. The positioning of the blocks 9 on the base therefore determine the longitudinal position of the banks of the rib boards 6. Since, each rib contacts a spacing block, the number of ribs in a single bank can if desired be reduced or increased.

Each rib board 6 has a recess 11 in the middle of its bottom surface 6*b*, the recess 11 being so shaped that the rod 10 snugly fits in and is accommodated by the recess 11. Thus the positioning of the rod 10 and the recesses 11 in the rib boards 6 determine the widthwise position of the rib boards 6. The banks of rib boards 6 are therefore easily removable from the base 2 and are also easily positioned in the base 2 by slotting the bank of rib boards 6 in position relative to the rod 10 and the spacer blocks 9.

The rib boards 6 are each in the form of generally flat sheets of tooling steel having a thickness of 12mm. The rib boards are positioned apart by 176mm. The rib boards may be provided with thickened portions in order to provide extra strength. The rib boards are substantially rigid and undergo negligible deformation under normal operating conditions.

The rib boards 6, once positioned on the base 2, are surrounded on all sides as viewed from above by removable side plates (not illustrated). The side plates are bolted to, and are supported by, the base 2. Also attached to the base are stops (not illustrated) that extend from the periphery of the upper surface of the base 2, but within the perimeter defined by the removable side plates. The stops define a boundary within which the intermediate member is positioned. The boundary defined by the stops closely matches the shape of the intermediate plate 12 as viewed from above, which itself has a shape, which, although slightly larger in plan view, closely matches the shape of the component 4. In use, the stops allow the intermediate plate 12 and the component 4 to be positioned on the surface in the correct position, within an acceptable tolerance distance, and yet also allow both the intermediate member and the component to slide freely by relatively small distances over the surface defined by the ribs. The intermediate member may thus be considered as being in floating contact with the ribs and the component may be considered as being in floating contact with the intermediate member. However, it is possible that in use portions or points of the intermediate member and/or the component do not move any substantial distance relative to the base.

The apparatus also includes a reusable silicone vacuum bag 5 (not shown in FIGS. 2 to 4) and a source of suction, which is provided by means of a vacuum pump. As can be seen in FIG. 5, the vacuum bag 5 is shaped such that the component 4, intermediate plate 12 and rib boards 6 are encompassed by the bag 5, the open end of which being attachable to the upper surface 2*b* of the base 2 by means of bag tape. The bag 5 is attached to the base 2 in the region next to the side plates (mentioned above) which are provided on the base and which surround the rib boards 6 as viewed in plan. The side plates prevent or mitigate suck-in of the bag 5 when a vacuum is drawn.

The process of creep forming of a component 4 will now be described with reference to FIG. 5. The component 4 is machined or manufactured such that the component 4 has a substantially flat side 4*a*, the side that will eventually form the outermost surface of the wing skin and a side 4*b* that has a shape that is not flat and that will form the surface of the wing skin inside the wing box of an aircraft. In this example, the component 4 is machined from a solid block of 7150 alloy. The intermediate plate 12 is placed on the base 2 and the component 4 is then placed on the tool 1 so that the flat surface 4*a* of the component 4 is placed against the uppermost surface 12*a* of the intermediate member 12.

A breather mat (indicated by line 13) is placed on top of the component 4 and then the vacuum bag 5 is placed over the component 4, intermediate plate 12 and the rib boards 6. The bag 5 is sealingly attached to the upper surface 2*b* of the base 2 by means of bagging tape attached to the base (see the end portion 5*a* of the bag 5 which indicates broadly where the bag tape is fixed). The vacuum bag 5 is connected to a source of suction, which then creates a vacuum within the bag 5. As air is drawn from the bag 5, the intermediate plate 12 and component 4 are urged towards the uppermost surfaces 6*a* of the ribs 6. The intermediate plate 12 and component 4 adopt the shape defined by the ribs 6 and are positioned within the area defined by the ridge. FIG. 5 shows schematically how the various parts are positioned at this stage in the process.

The whole apparatus 1 including the bag 5, which is still connected to a (remote) vacuum source, is placed in an autoclave. The apparatus 1 and component 4 are then subjected to suitable temperature and pressure profiles over time in order to creep-form the component 4.

In this particular embodiment, the autoclave is operated to provide a pressure difference of 7 bar (i.e. 6 bar above atmospheric pressure) and at an initial temperature of 120° C.±5° C. for five hours and then at a temperature of 155° C.±5° C. for 10 hours.

The intermediate plate 12 undergoes substantially no plastic deformation when forced against the ribs 6. The intermediate plate 12 presses against the upper surfaces 6*a* of the ribs 6 so that good contact is made between the plate 12 and the entire uppermost surface 6*a* of each rib 6 immediately opposite the plate 12. Similarly, the previously flat surface 4*a* of the component 4 is pressed against the opposing surface 12*a* of the intermediate member 12 so that there is good contact across substantially the entire surface area of that surface 4*a* of the component 4. The intermediate plate 12 is rigid enough that substantially no sagging of the plate 12 occurs in the gaps between the rib boards 6, yet is flexible enough that it deforms to the shape 3 that smoothly envelopes the uppermost surfaces 6*a* of the rib boards 6. The base modules 2*a* receive, resist and distribute the load sustained by the rib boards 6 from the forcing of the component 4 against the rib boards 6 via the intermediate plate 12.

After the apparatus and component have been subjected to the temperature and pressure profile mentioned above and allowed to cool to ambient temperature, the apparatus is removed from the autoclave and air is allowed to be slowly drawn back into the bag, thereby allowing the component 4 and intermediate member 12 to be released from the tool. At this stage the component 4 will undergo spring back, in that the shape of the component 4 will spring back partly towards its original flat shape. The intermediate plate 12 will spring back to a substantially flat plate.

Provided that operating conditions are substantially the same in successive runs, once the shape of the shaped surface has been found to produce a component 4 of the correct shape, there is generally no need to adjust the shape of the shaped surface, unless or until either the operating conditions are changed (for example, the temperature and pressures to which the component is subjected are changed greatly for some reason) or the ideal shape of the components to be produced changes.

However, when manufacturing a given shaped component for the first time, it is unlikely for the first shape selected for the shaped surface of the tool to be completely successful. Standard prior art methods are available to: select an initial shape of a shaped surface in order to produce a component of a target shape, but such methods rarely produce correct or acceptable solutions on the first attempt. It is likely for small portions of the components produced by means of the shaped surface to be incorrectly shaped. It may also be the case that the shape initially selected is such that it produces components having a shape that has not sprung back enough or has sprung back more than was expected so that the entire shape is incorrect.

When such errors are encountered during the initial set-up of a creep forming tool, one or more banks of rib boards may need replacing and/or the relative position of the base modules may need changing in order to remove or reduce the error in shape of the component produced compared to the ideal or target shape. Standard prior art methods are available to determine how the shape of the shaped surface should be changed in view of a given error. Such methods can be iterative in nature and several revisions of the shape of the shaped surface may be required.

Remedying errors in shape may be best performed by the replacement of one or more banks of rib boards, the repositioning one or more base modules, or a combination of the two. Local errors may for example, merely require the replacement of one or more banks of rib boards. Large errors in shape may be best dealt with by both replacing several banks of rib boards and repositioning several base modules. Errors that affect only the longitudinal (or spanwise) shape may be remedied by means of only repositioning the base modules relative to each other.

In order to move the position of one base module to another it will at least be necessary for the angle piece between the two base modules concerned to be removed, for the relative positions of the base modules to be modified, for support structure (i.e. the bogie unit) of the base module to be modified as necessary, and for an angle piece corresponding to the new angle between the base modules to be fixed to the base modules. The side plates and rib boards mounted on the base modules need not be moved in order to reposition the base modules. Banks of rib boards may simply be replaced by lifting a bank out and replacing with a bank of boards that is slotted into place. One or more side plates may need to be removed to facilitate access, but this need not necessarily be the case if suitable lifting gear is available to lift reliably and safely the banks out of the base and up and over the side plates.

It will be appreciated that various modifications could be made to the above-described embodiment without departing from the scope of the present invention.

For example, whilst the above described embodiment has four base modules arranged in series, fewer or greater base modules could be provided and/or arranged in a different configuration (for example, as two parallel rows of base modules).

If the component to be creep formed had properties such that no sagging between rib boards would occur, or if the rib boards were spaced apart such that no sagging would occur, the intermediate member could be dispensed with.

Whilst each rib provides a surface of contact across its entire length (i.e. widthwise across the base) for the intermediate plate, the ribs could instead be provided in two or more rows of ribs, each row running spanwise along the length of the base, there being a gap between adjacent rows.

Rather than having discrete stops that restrict movement of the intermediate plate and the component, the tool could be provided with a single ridge that defines the boundary within which the intermediate plate and the component are able to move.

The ribs need not be evenly spaced apart.

The intermediate plate need not be of uniform thickness.

The apparatus and component may be subjected to different pressure and temperature profiles in the autoclave. Pressure differences may range from between 2 and 15 bar, more preferably between 5 and 10 bar. Temperatures may range from 100 C. to 200 C. The total time in the autoclave may be between 6 and 20 hours.

The invention claimed is:

1. Apparatus for modifying the shape of an aircraft component by creep forming the component, the apparatus including:

a shaped surface so arranged that an aircraft component may be forced against the shaped surface in a manner that modifies the shape of the aircraft component, an intermediate member for receiving and supporting the component, said intermediate member is positioned between the shaped surface and the component, and deforms to a shape dependent on the shape of the shaped surface, wherein the shaped surface is defined by an open structure, the open structure including spaced apart elements separated by gaps, the shape to which the component may be modified being dependent on the shape defined by a notional smooth surface enveloping the elements and bridging the gaps, the intermediate member being sufficiently stiff that during the forcing of the aircraft component against the shaped surface, the intermediate member deforms substantially to the shape of said notional smooth surface, but suffers substantially no local deformation in regions of the intermediate member that bridge the gaps.

2. An apparatus according to claim 1, wherein the intermediate member is generally sheet-like in shape.

3. An apparatus according to claim 2, wherein the intermediate member has a constant thickness across the majority of its area.

4. An apparatus according to claim 1, wherein the intermediate member is, prior to use of the apparatus, substantially flat.

5. An apparatus according to claim 1, wherein the intermediate member is such that it repeatedly deforms to substantially the same shape, that shape being dependent on the shape of the shaped surface.

6. An apparatus according to claim 1, wherein the intermediate layer is arranged to be free to move over the shaped surface within predefined boundaries.

7. An apparatus according to claim 1, wherein the apparatus is arranged such that the aircraft component is free to move in directions substantially parallel to the shaped surface.

8. An apparatus according to claim 7, wherein the apparatus is arranged such that, in use, the aircraft component is prevented from moving beyond predefined boundaries.

9. An apparatus according to claim 1, wherein the shaped surface comprises an open structure.

10. An apparatus according to claim 9, wherein the open structure comprises a multiplicity of spaced apart elements and the shape to which the component may be modified is dependent on the shape defined by a notional surface that envelopes the elements.

11. An apparatus according to claim 1, wherein the shaped surface is defined by a multiplicity of separate elements.

12. An apparatus according to claim 11, wherein the elements are arranged in groups, each group comprising a plurality of elements, the elements in each group being mounted in fixed relation to each other.

13. An apparatus according to claim 10, wherein the elements are in the form of ribs.

14. An apparatus according to claim 10, wherein the elements are removably mounted on the apparatus.

15. An apparatus according to claim 10, wherein the elements are fixed in position on the apparatus by means of a portion of the element that engages with a corresponding portion of the apparatus, the portions and corresponding portions being shaped such that they do not restrict movement of the elements away from the apparatus.

16. An apparatus according to claim 1, wherein the shaped surface is rigid.

17. An apparatus according to claim 1, wherein the apparatus is arranged such that the component is, in use, forced against the shaped surface by means of an air pressure difference.

18. An apparatus according to claim 17, wherein the air pressure difference is at least partially provided by suction.

19. An apparatus according to claim 18, wherein the suction is provided via a bag of a bagging apparatus.

20. Apparatus for modifying the shape of an aircraft component by creep forming the component, the apparatus including:

a shaped surface so arranged that an aircraft component may be forced against the shaped surface in a manner that modifies the shape of the aircraft component, an intermediate member located between said shaped surface and said aircraft component, and a bagging apparatus wherein the bagging apparatus is arranged such that the component is forced against the shaped surface by means of an air pressure difference that is at least partially provided by suction via said bagging apparatus, wherein the shaped surface is defined by an open structure, the open structure including spaced apart elements separated by gaps, the shape to which the component may be modified being dependent on the shape defined by a notional smooth surface enveloping the elements and bridging the gaps, the intermediate member being sufficiently stiff that in use during the forcing of the aircraft component against the shaped surface, the intermediate member deforms substantially to the shape of said notional smooth surface, but suffers substantially no local deformation in regions of the intermediate member that bridge the gaps.

21. An apparatus according to claim 19, wherein the apparatus is arranged such that the bag, in use, must encompass both the aircraft component and at least a portion of the apparatus on the opposite side of the shaped surface to the aircraft component.

22. An apparatus according to claim 19, wherein the apparatus includes a base which supports the shaped surface and the apparatus is arranged such that the bag, in use, must at least partially be sealingly attached to the base.

23. An apparatus according to claim 19, wherein the bag is reusable.

24. An apparatus according to claim 1, wherein the apparatus is in the form of a creep-forming tool.

25. An apparatus according to claim 1, wherein the apparatus is arranged so that it is suitable for modifying the shape of metallic components.

26. A method of modifying the shape of an aircraft component by creep forming the component, the method including the steps of providing a shaped surface and an intermediate member, said intermediate member located between said shaped surface and said aircraft component, wherein the shaped surface is defined by an open structure, the open structure including spaced apart elements separated by gaps, the shape to which the component may be modified being dependent on the shape defined by a notional smooth surface enveloping the elements and bridging the gaps, the intermediate member being sufficiently stiff that during the forcing of the aircraft component against the shaped surface, the intermediate member deforms substantially to the shape of said notional smooth surface, but suffers substantially no local deformation in regions of the intermediate member that bridge the gaps, forcing an aircraft component against the shaped surface, via the intermediate member, in a manner that modifies the shape of the aircraft component, and removing the aircraft component.

27. A method according to claim 26, wherein immediately prior to the performance of the step of forcing the component against the shaped surface, the intermediate member is substantially flat.

28. A method according to claim 26, wherein the method is performed a multiplicity of times and the same intermediate member is used on each occasion.

29. A method according to claim 26, wherein the step of forcing of the aircraft component against the shaped surface causes the aircraft component to undergo plastic deformation.

30. A method according to claim 26, wherein the method includes a step of releasing the component from the shaped surface and after the release of the component the shape of the component changes significantly.

31. A method according to claim 26, wherein, before performance of the step of forcing of the aircraft component against the shaped surface, the aircraft component is generally flat in shape.

32. A method according to claim 26, wherein, during performance of the step of forcing of the aircraft component against the shaped surface, the aircraft component slides over the shaped surface within predefined boundaries.

33. A method according to claim 26, wherein the aircraft component is forced against the shaped surface by means of an air pressure difference.

34. A method of modifying the shape of an aircraft component by creep forming the component, the method including the steps of providing a shaped surface, wherein the shaped surface is defined by an open structure, the open structure including spaced apart elements separated by gaps, the shape to which the component may be modified being dependent on the shape defined by a notional smooth surface enveloping the elements and bridging the gaps, an intermediate member, positioned between said shaped surface and said component, being sufficiently stiff that during the forcing of the aircraft component against the shaped surface, the intermediate member deforms substantially to the shape of said notional smooth surface, but suffers substantially no local deformation in regions of the intermediate member that bridge the gaps, forcing, by means of an air pressure difference, an aircraft component against the shaped surface in a manner that modifies the shape of the aircraft component, and removing the aircraft component, wherein the air pressure difference is at least partially provided by suction via a bag of a bagging apparatus, the bag encompassing both the aircraft component and at least a portion of the support structure on the opposite side of the shaped surface to the aircraft component.

35. A method according to claim 34, wherein the shape of a further aircraft component is modified by performing the method with the use of the same bag.

36. A method of creep forming a metallic component including performing the steps of the method of claim 26.

* * * * *